US011254493B2

(12) United States Patent
Kim et al.

(10) Patent No.: US 11,254,493 B2
(45) Date of Patent: Feb. 22, 2022

(54) FOLDABLE CONTAINER

(71) Applicant: Koelt Co., Ltd., Pohang-si (KR)

(72) Inventors: Sung-Han Kim, Daegu (KR); Sun-Young Park, Seoul (KR)

(73) Assignee: KOELT CO., LTD.

( * ) Notice: Subject to any disclaimer, the term of this patent is extended or adjusted under 35 U.S.C. 154(b) by 100 days.

(21) Appl. No.: 16/489,448

(22) PCT Filed: Jul. 19, 2017

(86) PCT No.: PCT/KR2017/007765
§ 371 (c)(1),
(2) Date: Aug. 28, 2019

(87) PCT Pub. No.: WO2019/009457
PCT Pub. Date: Jan. 10, 2019

(65) Prior Publication Data

US 2020/0115152 A1 Apr. 16, 2020

(30) Foreign Application Priority Data

Jul. 4, 2017 (KR) ..... 10-2017-0084645

(51) Int. Cl.
*B65D 88/52* (2006.01)
*B65D 88/12* (2006.01)
*B65D 90/00* (2006.01)

(52) U.S. Cl.
CPC ..... *B65D 88/524* (2013.01); *B65D 88/121* (2013.01); *B65D 90/008* (2013.01); *B65D 2590/02* (2013.01); *B65D 2590/666* (2013.01)

(58) Field of Classification Search
CPC .... B65D 88/524; B65D 88/522; B65D 88/52; B65D 88/121; B65D 88/12; B65D 90/0086; B65D 90/008; B65D 43/20; B65D 43/16; B60P 7/15
USPC ..... 220/6, 1.5, 812, 811, 810; 206/600; 410/150, 143
See application file for complete search history.

(56) References Cited

U.S. PATENT DOCUMENTS 4,577,772 A * 3/1986 Bigliardi ..... B65D 88/121 220/1.5
4,646,928 A * 3/1987 Ono ..... B65D 88/524 220/1.5
4,726,486 A * 2/1988 Masuda ..... B65D 90/0086 220/1.5
4,848,618 A * 7/1989 Yuan ..... B65D 88/524 220/1.5

* cited by examiner

*Primary Examiner* — Robert J Hicks
(74) *Attorney, Agent, or Firm* — Mark T. Vogelbacker; Eckert Seamans Cherin & Mellott, LLC

(57) ABSTRACT

A foldable container enables the entire height of a folded state thereof to be one fifth of the entire height of the state of being folded, such that the height of an international standard container can be satisfied even though empty containers are stacked in five stages. To this end, the hexagonal foldable container can include an upper panel part and a lower panel part respectively forming the upper surface and lower surface thereof; a left panel part and a right panel part respectively forming the left surface and right surface thereof, and respectively folded; a front panel part and a rear panel part respectively forming the front surface and rear surface thereof; and a fixing bar provided at the outer surface of the rear panel part.

18 Claims, 15 Drawing Sheets

[Figure 1]
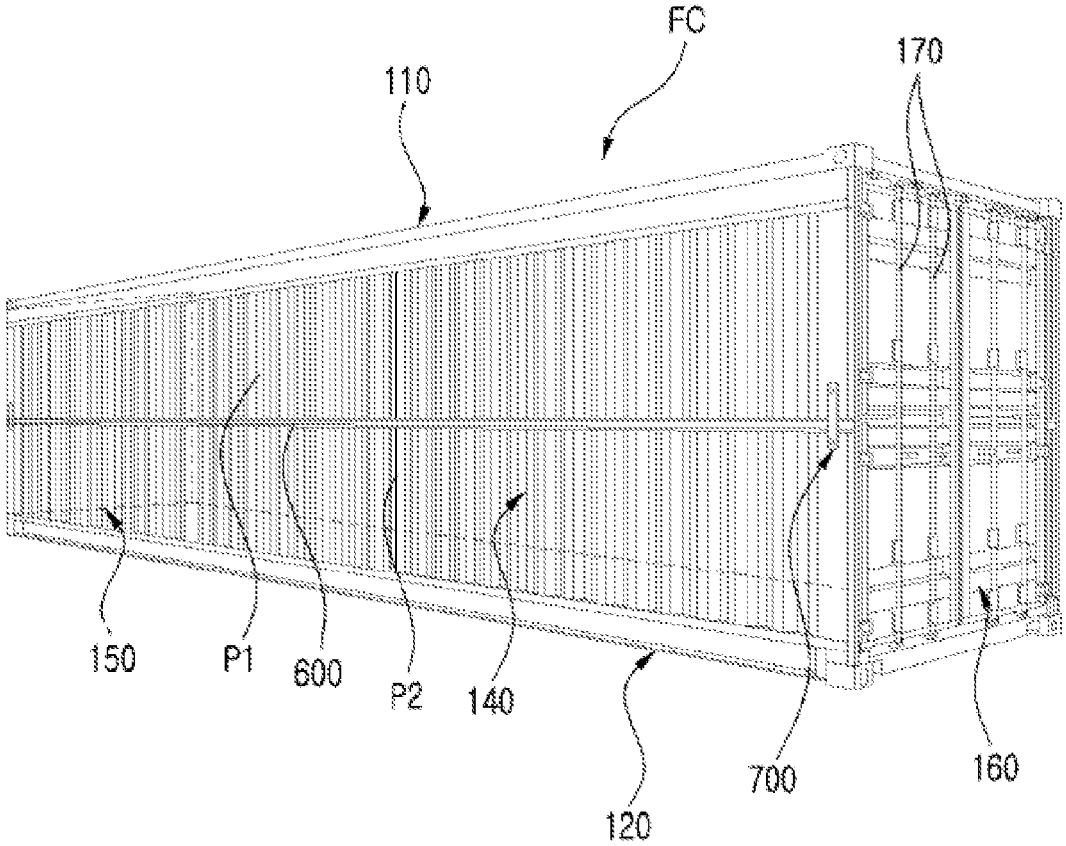

[Figure 2]
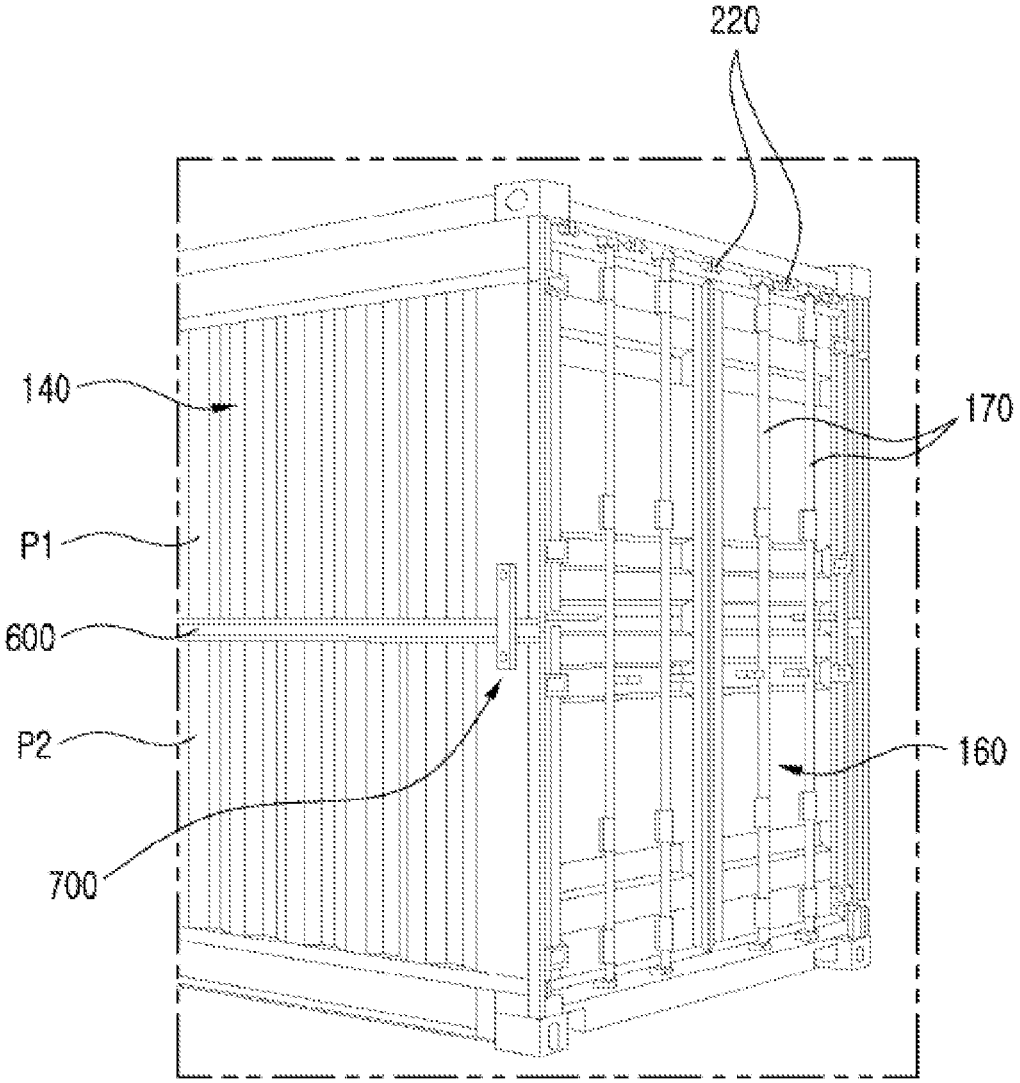

[Figure 3]
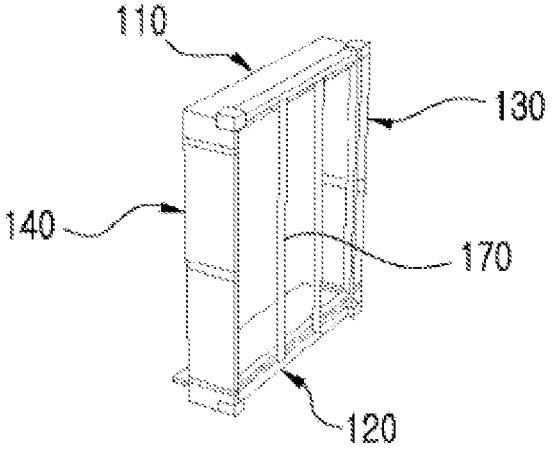
(a)
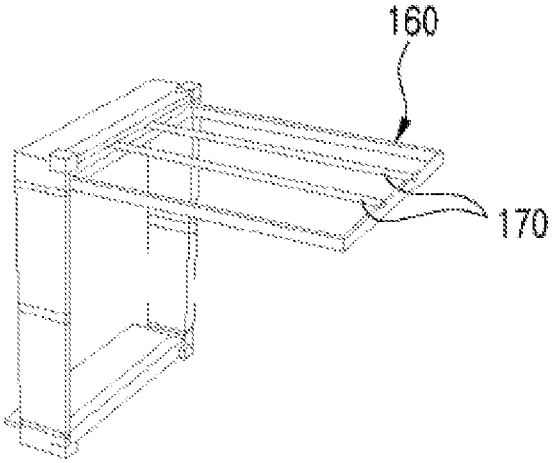
(b)
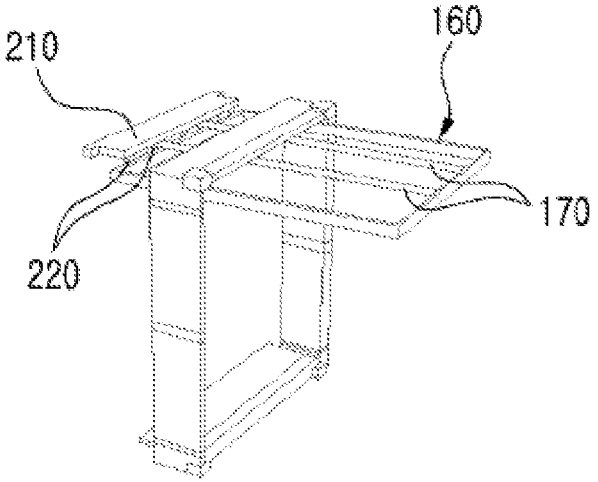
(c)

[Figure 4]
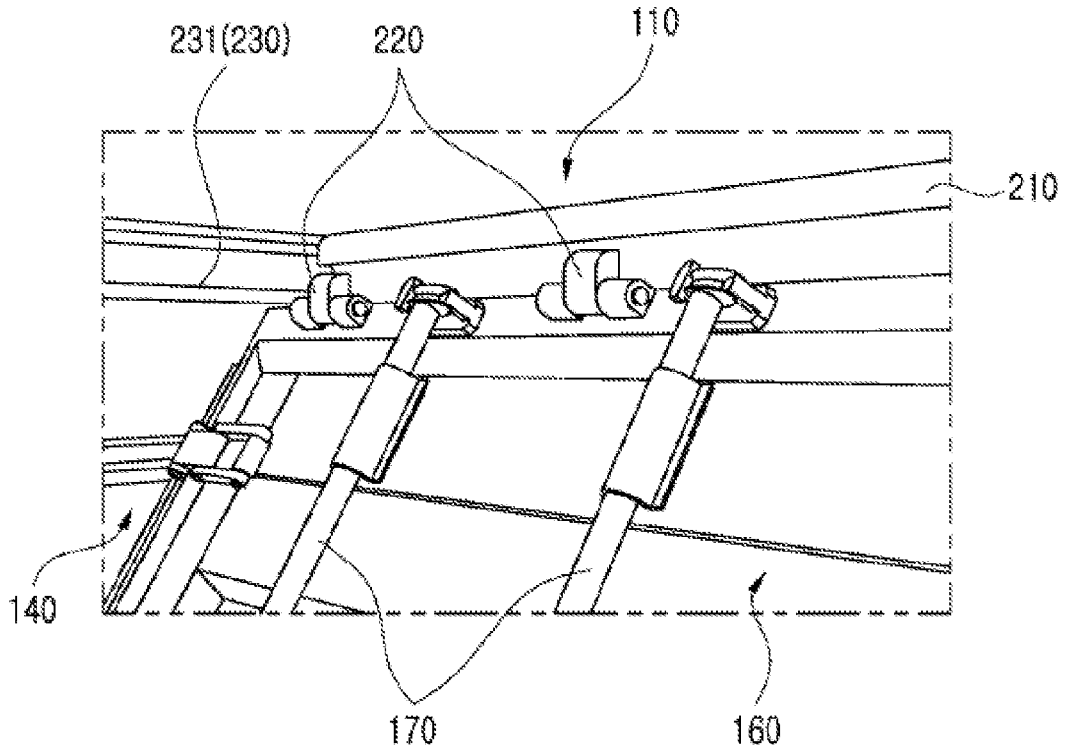
[Figure 5]
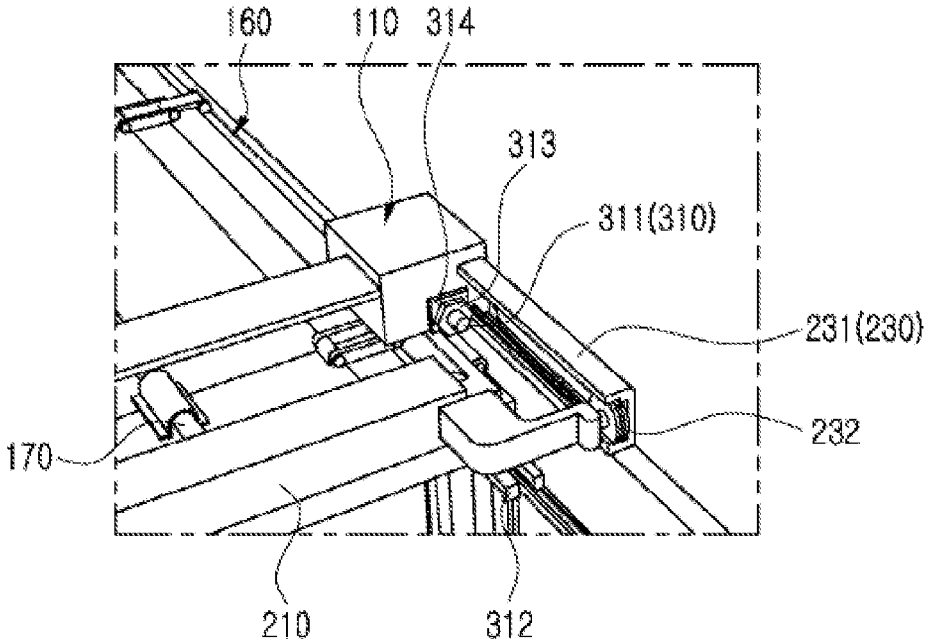

[Figure 6]
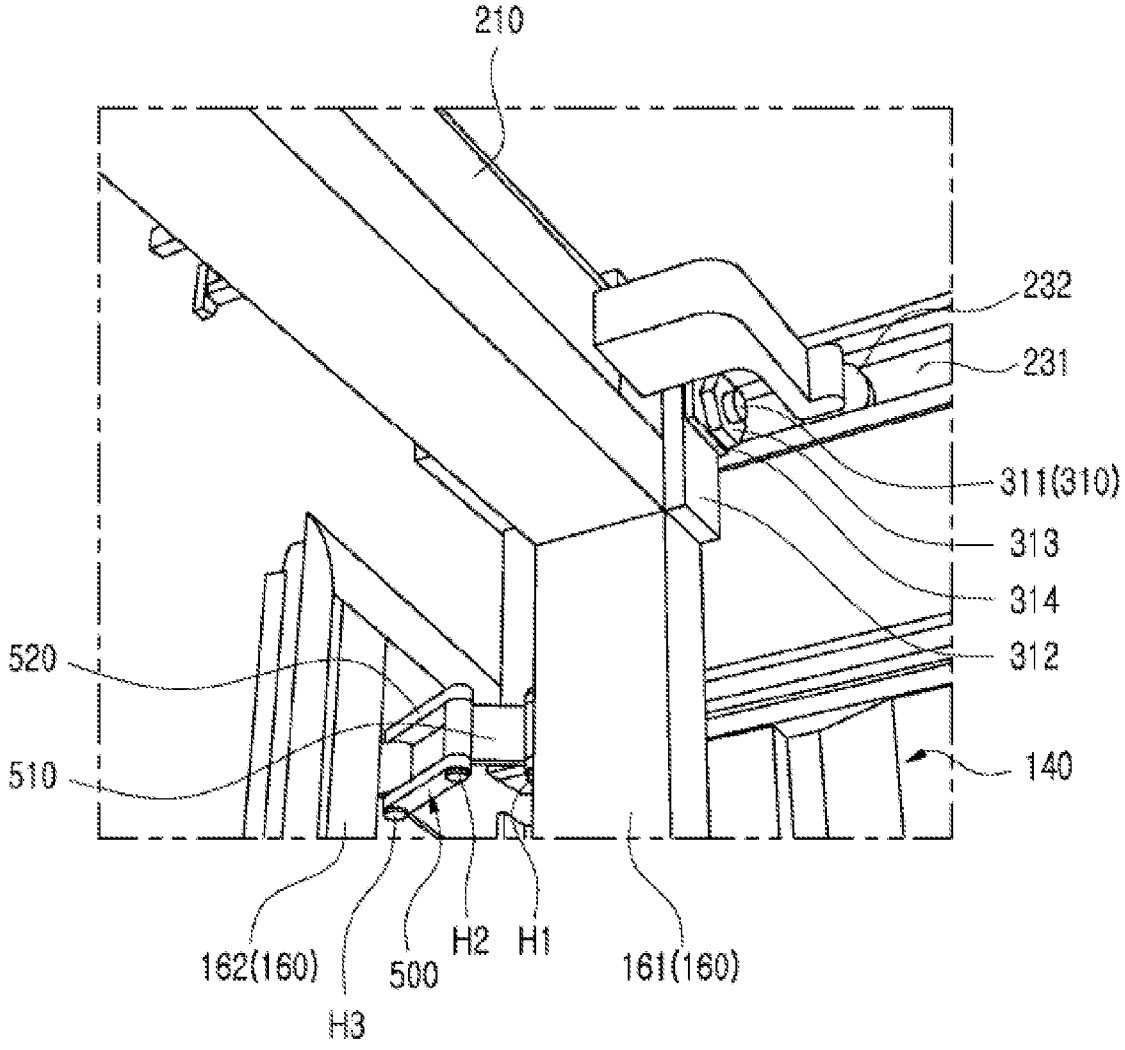

[Figure 7]
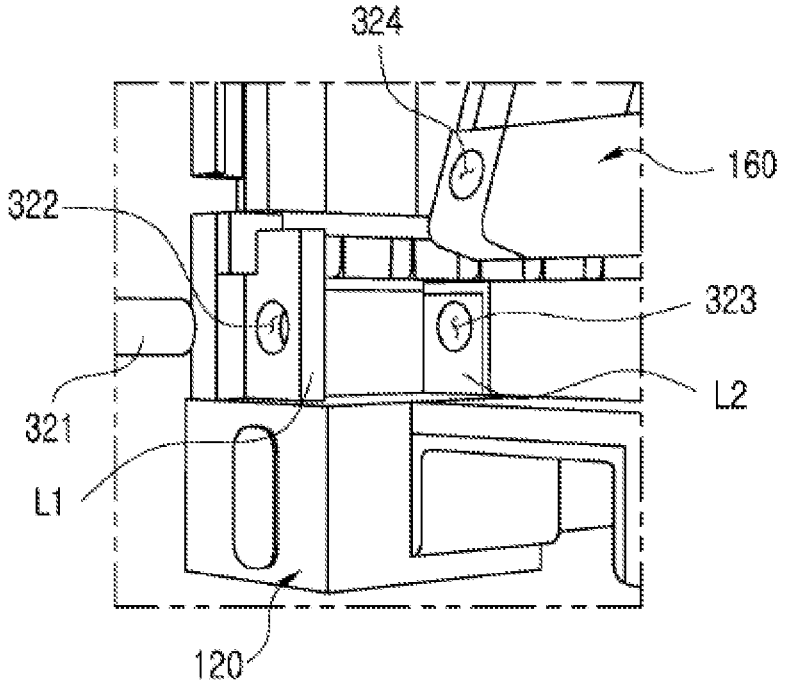
(a)
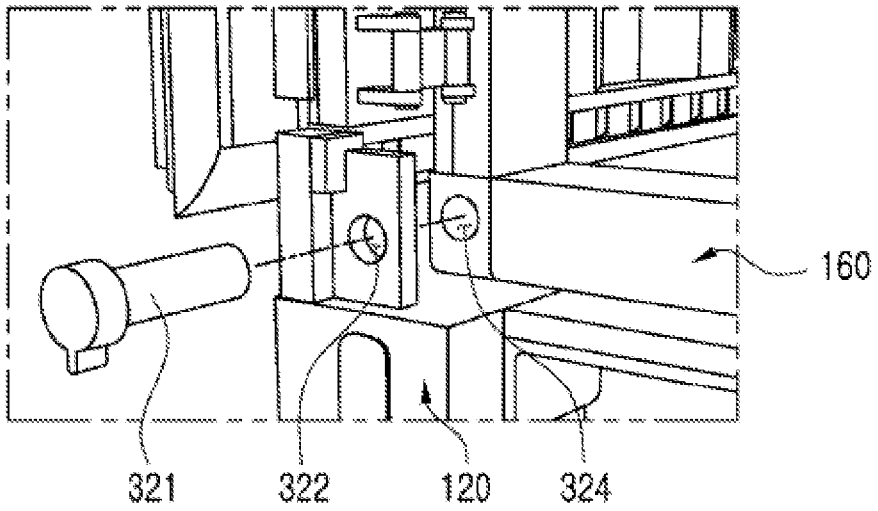
(b)

[Figure 8]
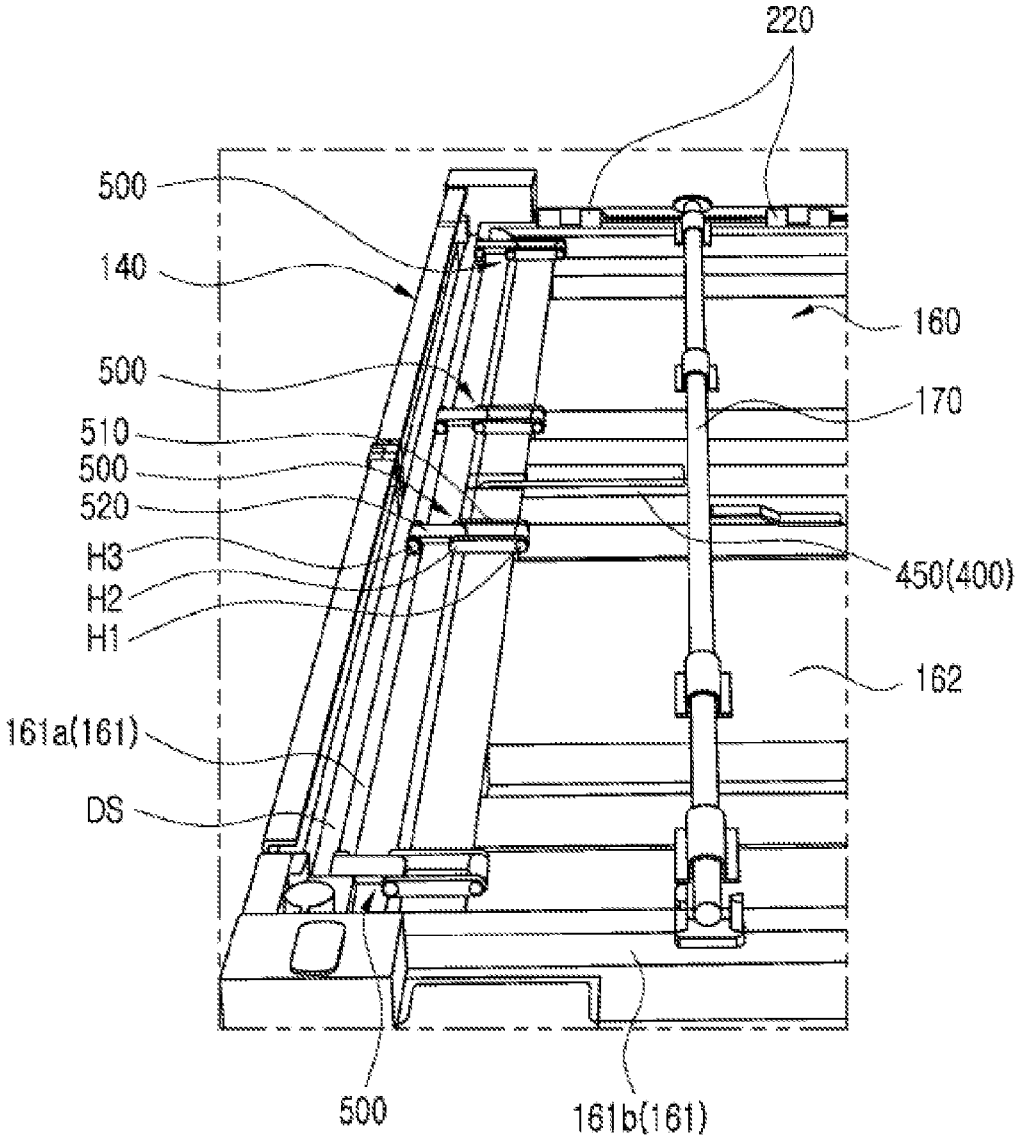

[Figure 9]
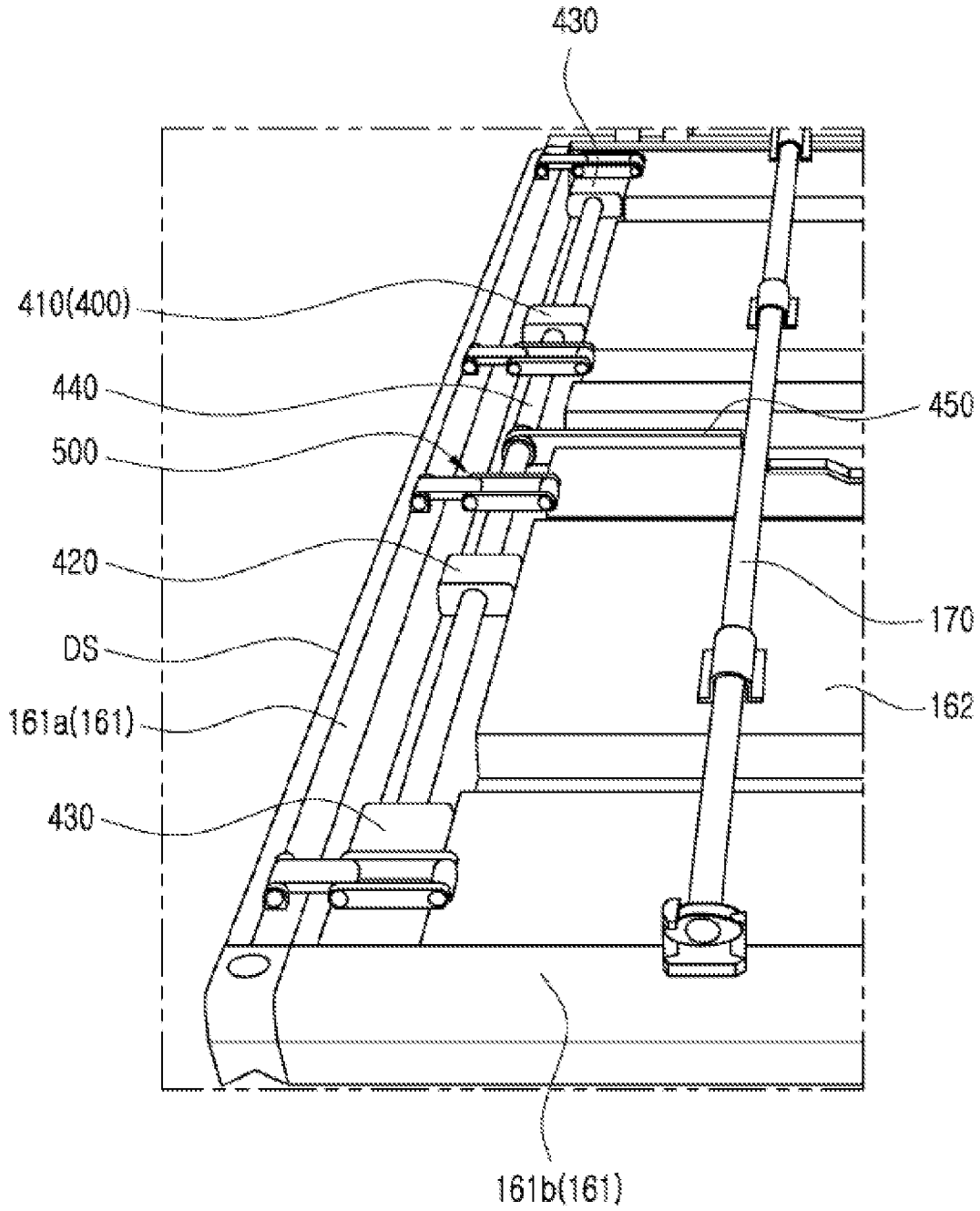

[Figure 10]
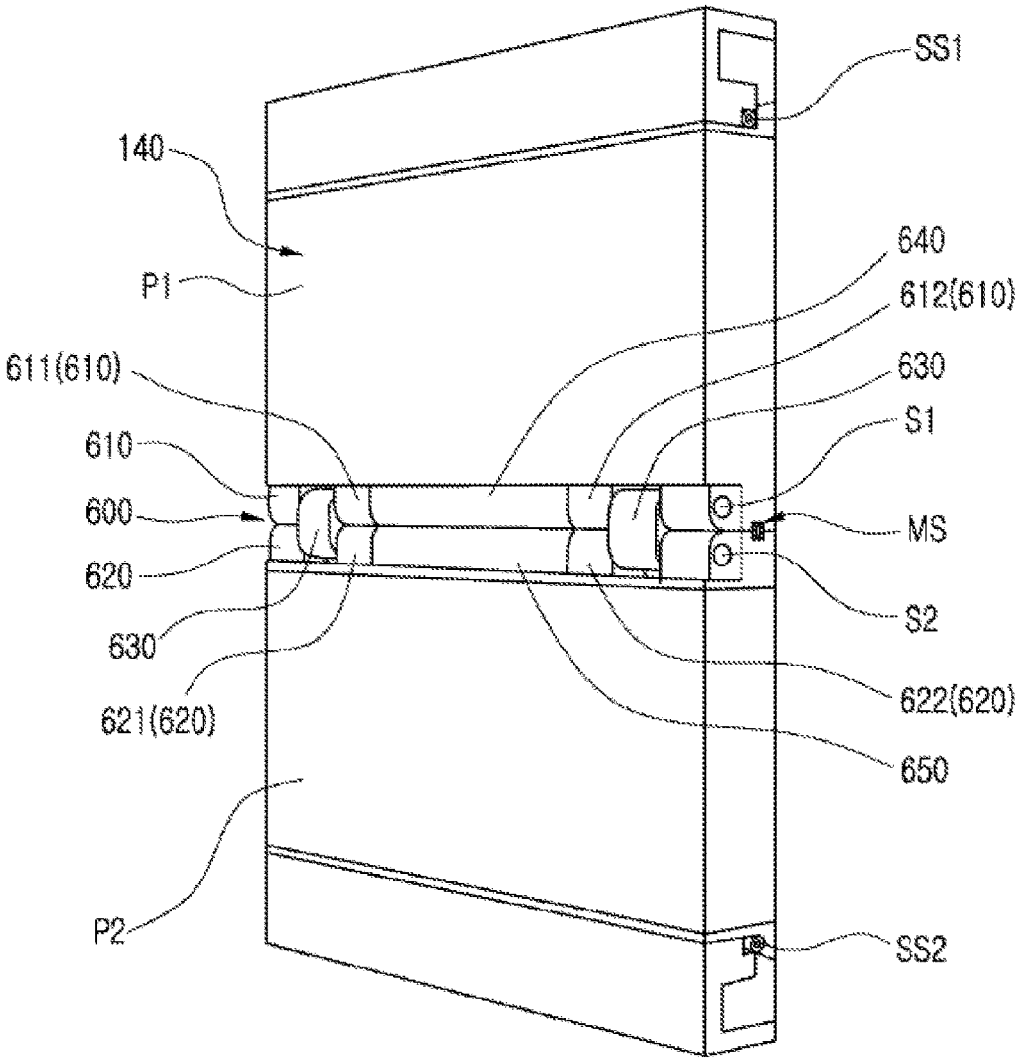
[Figure 11]
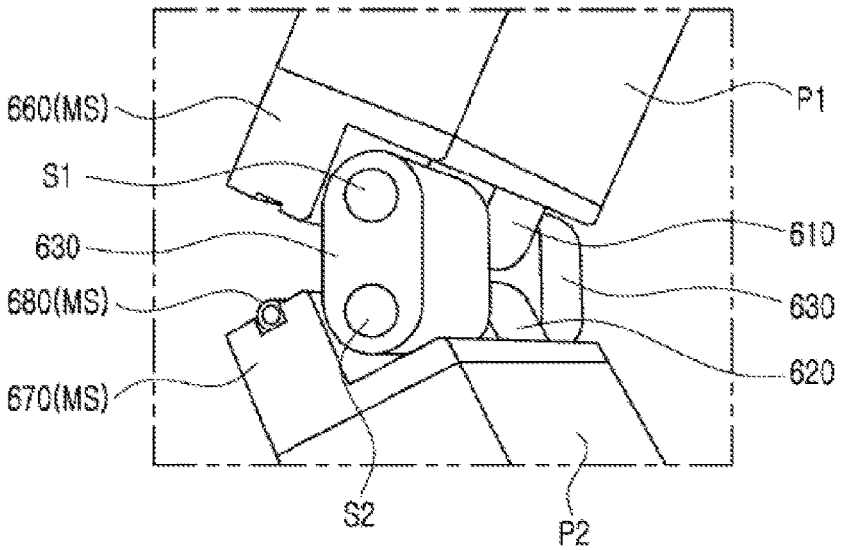

[Figure 12]
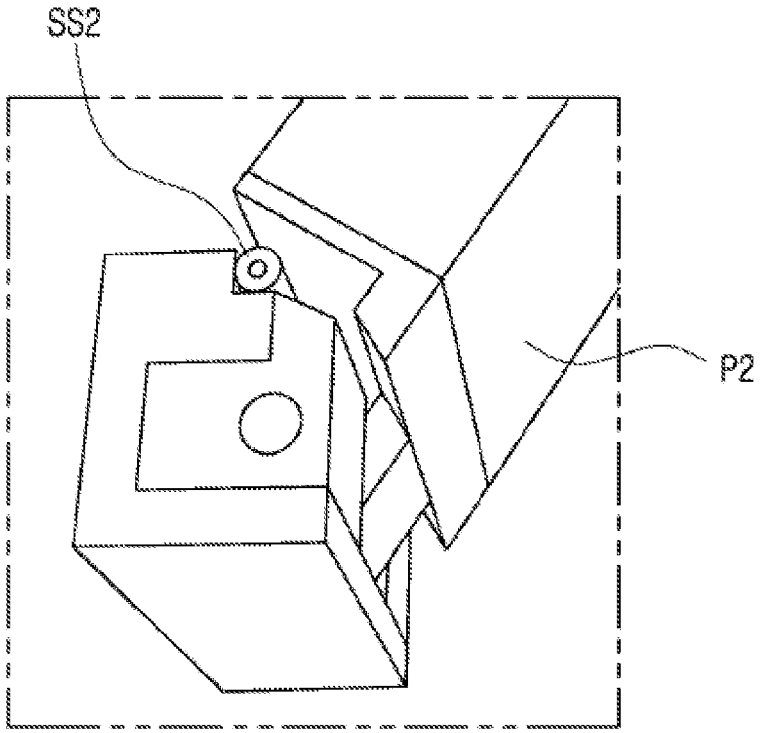

[Figure 13]
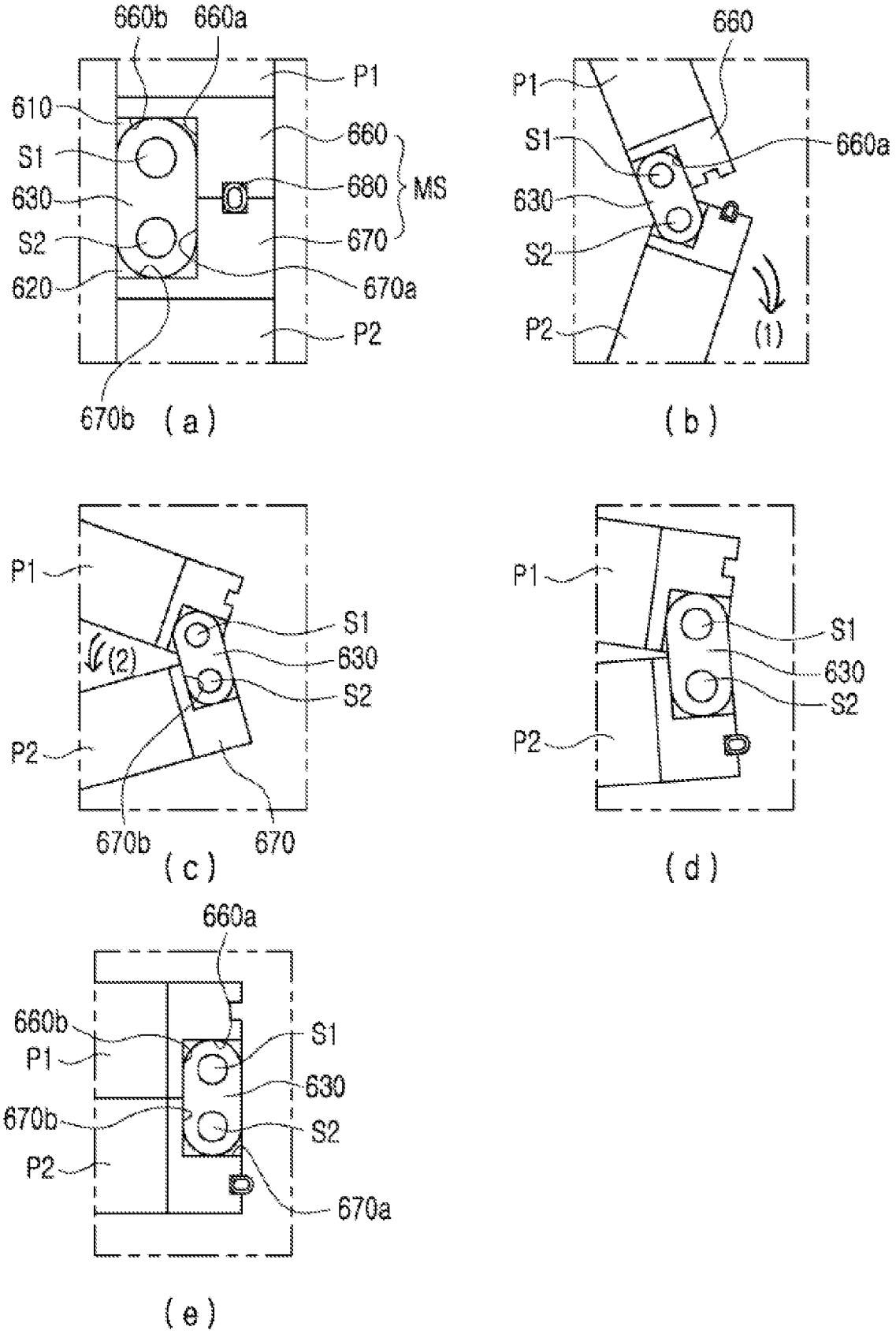

[Figure 14]
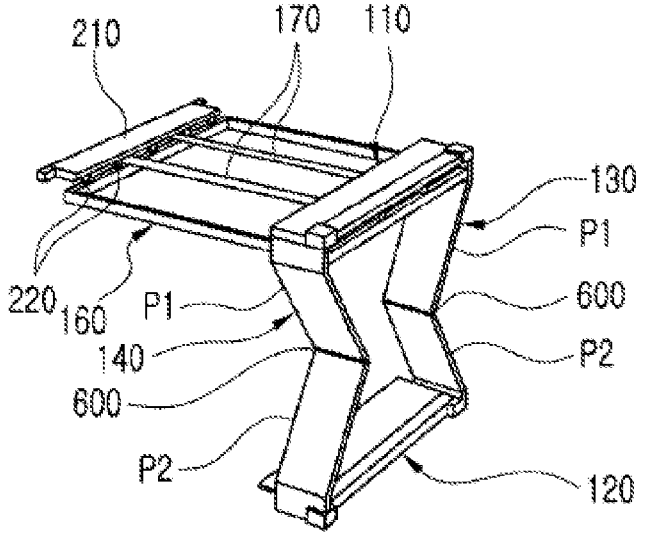
(a)
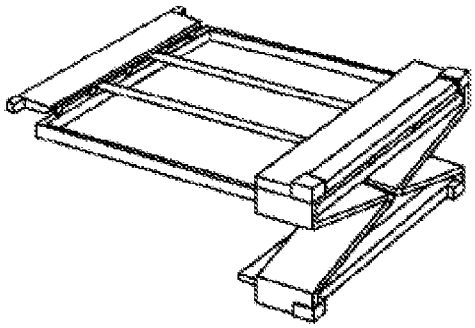
(b)
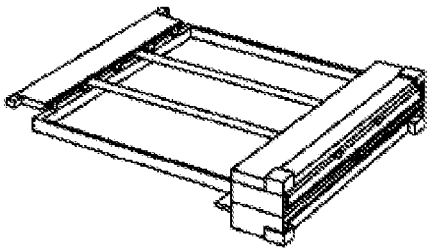
(c)

[Figure 15]
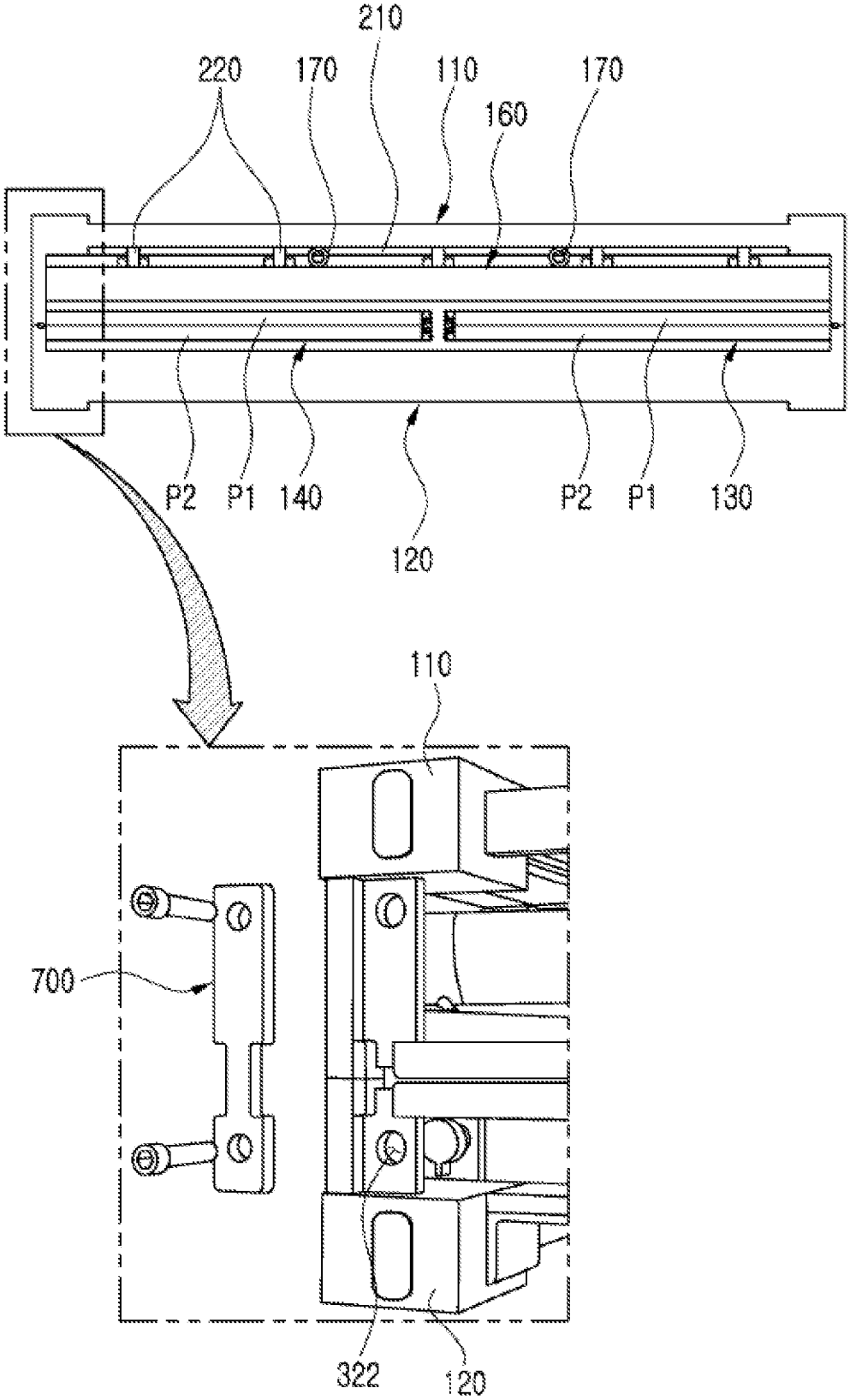

[Figure 16]
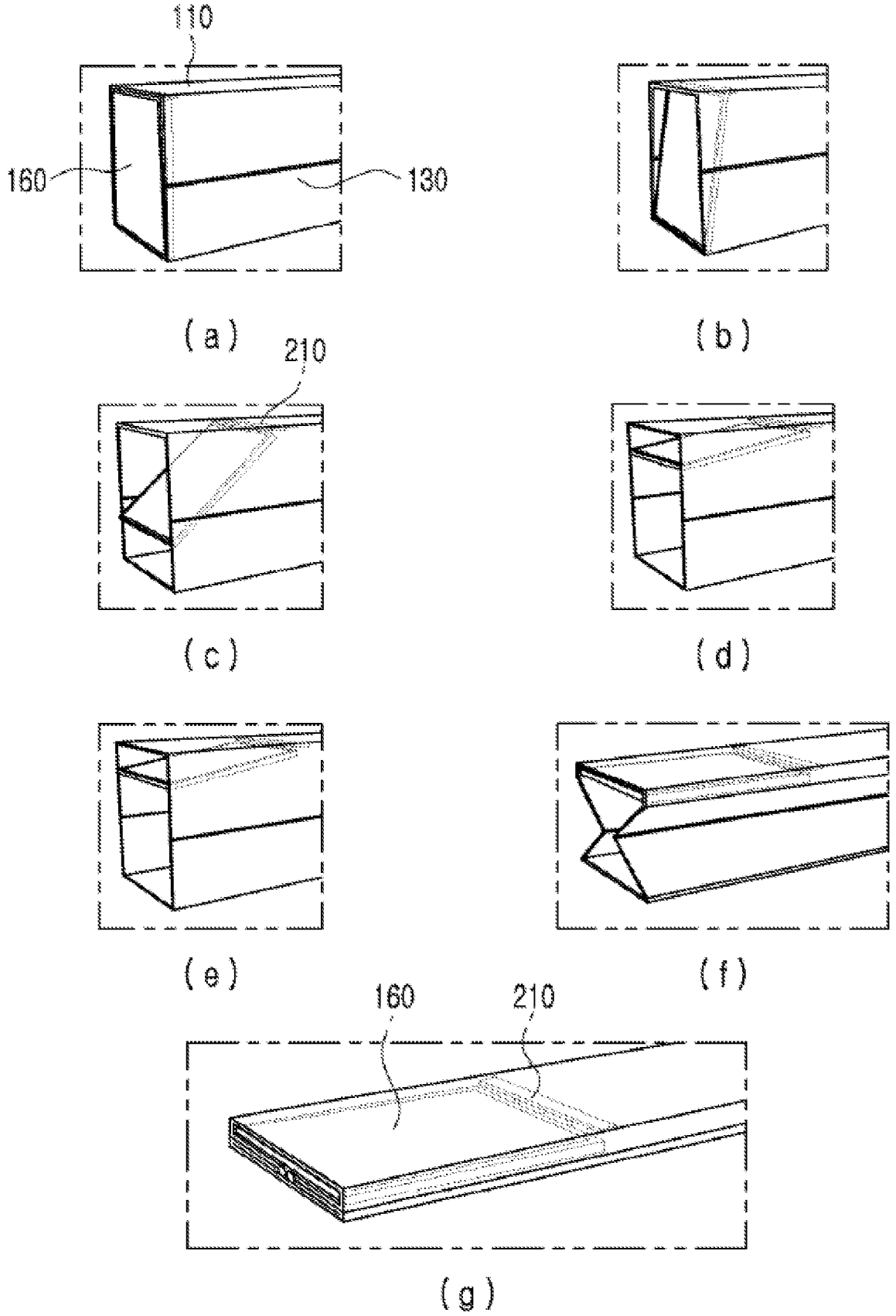

[Figure 17]
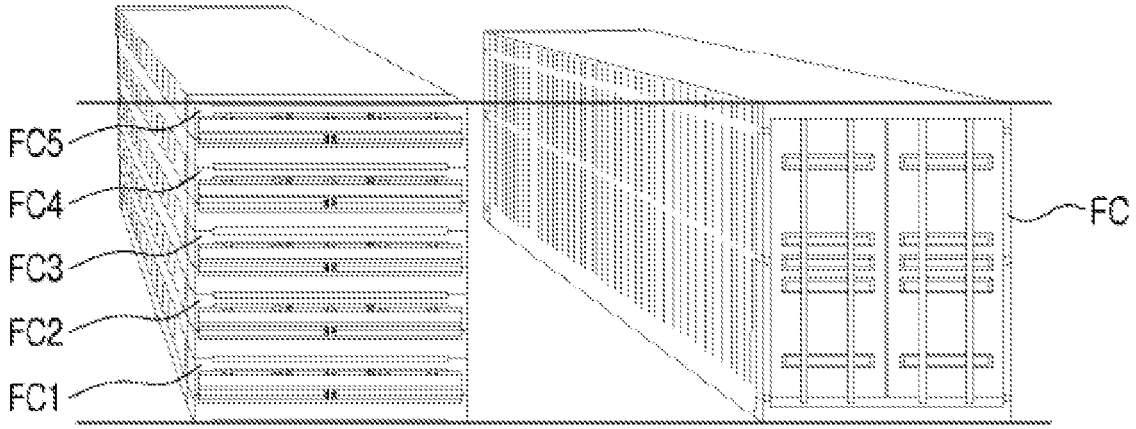

FOLDABLE CONTAINER

TECHNOLOGICAL FIELD

The present invention is about a container.

BACKGROUND TECHNOLOGY

Generally, containers are box-shaped and are used for efficiently and economically transporting freights and container sizes are internally specified in order to ensure that device interfaces can be shared across all industrial fields including freights loaded on containers, freight packages, transportation equipment, and transportation environment (land, sea, air).

Due to the fact that containers are made of steel, containers take up same amount of space regardless of whether they are loaded with freights or empty. Therefore, even when empty containers are stored or transported, same amount of space and expenses are required.

The conventional technology to resolve such a problem is the foldable container presented in Korea Patent Publication No. 10-2016-0146027 that includes a lower panel, an upper panel that is positioned parallel to the lower panel, the first side panel and the second side panel whose upper end lower ends are each connected to the upper panel and the lower panel lengthwise to the upper panel and the lower panel to be able to be rotated and which are configured to be folded in the inner direction of the foldable container, and the front panel and the rear panel that are connected to both ends of the lower panel in such a way that each lower end can be rotated by a hinge. Also, the first side panel and the second side panel includes the upper side panel connected to the upper panel by a hinge, the lower side panel that is located at the lower side of the upper side panel and that is connected to the lower panel by a hinge, and one or more sliding joints that connect the upper side panel and the lower side panel. Also, although it is not stated directly in the existing publication, the rear panel is used as a door that is opened and closed by rotating left and right, and at the rear panel used as the door, multiple fixing bars, which can be installed to and removed from the door frame, are located vertically at the outer side of the rear panel in order to prevent opening during transportation.

Therefore, when both ends of the upper panel are simultaneously lowered with the first and second dedicated devices after lifting both ends of the upper panel with the first and second dedicated devices (refer to FIG. 33 of the existing publication) and simultaneously or separately rotating the front panel and the rear panel with the first and second dedicated devices, it is possible for each of the first and second side panels to be folded with the sliding joint as the reference point. Especially, due to such a folding structure it is possible for the entire height of the container in the folded state could be ¼ of the entire height of the container (international specification is 2,896 mm) before being folded, so it is possible to transport folded containers in four layers (refer to FIG. 36 of the existing publication), thereby saving both space and cost.

However, thickness of each of the upper panel, lower panel, upper side panel, lower side panel, and door panel conventional foldable container described above is already set, height of space allowed for movement between each panel is already set, the height (for example, 35 mm) of the space to accommodate a hinge between the lower panel's floor side and the inner side of the rear panel is set, and the height to accommodate fixing bars described above between the rear panel's outer side and the lower side panel (for example, 65 mm) is set, so there are structural limitations to further reduce the thickness of each panel and the height of each space to lower the entire height of the container in the folded state to one fifth of the entire container before being folded.

Also, since the first and second dedicated devices are required in order to lift the upper panel, so extra expenses could be incurred in order to fold these. Also, due to the fact that the sliding joint's first and second fixed parts do not have binding power, the upper panel rolls left and right in the lengthwise direction of the container, and the first and second dedicated devices are required to support both ends of the upper panel.

DETAILED DESCRIPTION OF THE INVENTION

Technological Issues

The purpose of the present invention is to provide a foldable container whose height is one fifth of the entire height of the container before being folded in order to meet the container height according to the international specifications even if empty containers are loaded in five layers.

Another purpose of the present invention is to provide a foldable container that can be folded while minimizing additional expenses and that can improve structural stability.

Methods to Resolve the Issues

In order to achieve the above purposes, the foldable container according to an embodiment of the present invention is a foldable container in the shape of a hexagon that includes the upper panel and the lower panel that comprise the upper side and the lower side, respectively, the left panel and the right panel that comprise the left side and the right side, respectively, the front panel and the rear panel that comprise the front side and the rear side, respectively, and fixing bars that are installed on the outer side of the above rear panel, and includes the first and second supporting members that are installed in such a way as to be able to move forward and backward at the inner side of the above upper panel, and the above front panel and the above rear panel are installed on the above first and second supporting members, respectively, through the top end hinge in order for each of the outer sides to gradually move upward.

Each of the above supporting members could be installed to be able to move back and forth inside the above upper panel by the above back-and-forth movement guide part.

The above back-and-forth guide part could include a guide rail installed in the lengthwise direction of each of the left side end and the right side end of the inner side of the above upper panel, the first roller part that is installed on each of both ends of the above first support and equipped with one or more rollers to be able to slide on each of the above guide rails, and the second roller part installed on each of both ends of the above second support and equipped with one or more rollers to be able to slide on each of the above guide rails.

The foldable container according to the embodiment of the present invention described above could additionally include a locking part that intercepts the rotation of the above rear panel and the back-and-forth movement of the above second support.

The above locking part could include the upper locking part that fastens the above rear panel's upper end and the above upper panel's rear end and the lower locking part that fastens the above rear panel's lower end and the above lower panel's lower end.

The above rear panel could include a door frame in the shape of a rectangular frame equipped with a vertical bar and a horizontal bar and a door panel installed in such a way as to be able to rotate left and right on the above door frame.

The foldable container according to the embodiment of the present invention described above could additionally include a weight dispersion part that disperses the contraction weight in the horizontal direction that impacts the vertical bar of the above door frame to the above door frame's horizontal bar through the above door panel.

The above weight dispersion part could include the first and second latching parts that are installed in a vertical direction inside the above door panel, the third handing part that is installed on the above door frame's above horizontal bar's upper horizontal bar and lower horizontal bar, respectively, in order to correspond to the above first and second latching parts, and a long elastic part that latches on the above first and second latching parts, that elongates when the above foldable container is in the pre-folded state to latch on to the above third latching part, and that contracts that the above foldable container is in the folded state to be removed from the above third latching part.

The above rear panel could further include a hinge that rotates the above door panel by 270 degrees in the left direction or right direction relative to the above door frame by preventing the above door panel from latching to the above left panel or above right panel while being opened by rotating left and right.

The above door hinge could include the first hinge installed in such a way that one end could be rotated by the first hinge axis on the above door panel and the second hinge that one end can be rotated by the second hinge axis on another end of the above first hinge and another end can be rotated by the third hinge axis on the above door frame.

Sealing parts could be installed on the areas where the above upper panel, lower panel, left panel, right panel, front panel, and rear panel intersect.

Each of the above left panel and above right panel could include the upper side panel that is installed on the above upper panel so that the upper end can rotate, a side panel on the lower part's side that is installed so that the lower end can rotate on the above lower panel, and a side rotation guide that is connected so that the above upper part's side panel's lower end and the above lower part's side panel's upper end can rotate mutually and that guides rotation so that the above upper part's side panel and the above lower part's side panel can be folded by sloping to the above foldable container's inside.

The above side rotation guide is installed on the above upper part's side panel's lower end and could include one or more upper arc guiders with the upper circular arc part in the shape of a circular arc, lower arc guiders that are installed on the upper end of the above lower part's side panel and equipped with lower circular arc parts in the shape of a circular arc that rotate by coming into contact with the above upper circular arc part, the first side rotation axis that is installed in such a way to be able to rotate at the center of the above upper side's circular arc part of each of the above upper side arc guiders, the second side rotation axis that is installed at the center of the above lower side circular arc part of each of the above lower side arc guiders to be able to rotate, and one or more link materials that connect the above first side rotational axis and the above second side rotational axis.

The above one or more upper side arc guiders could include the first and second sides' arc guiders, the above one or more lower side arc guiders could include the first and second lower side arc guiders, and the above side rotational guide part could additionally include an upper side arc spacer that covers the space between the above first and second upper side arc guiders and that has an upper side circular arc cover in the shape of a circular arc and a lower side arc spacer that covers the space between the above first and second lower side arc guiders and that rotates by coming into contact with the above upper side circular arc cover.

The above on or more upper side arc guiders could include multiple side arc guiders, and the above multiple upper side arc guiders could be relatively densely positioned in the areas near the above front panel and the above rear panel of the above upper part's side panel's lower part, and could be positioned relatively separately at the center of the above upper part's side panel.

The above side rotation guide part could additionally include a middle sealing part between the above upper side arc guider and the above lower side arc guider.

Part of the above middle sealing part could include an upper fixed frame whose one part is installed between the above upper part's side panel's lower end and the above upper side's arc guider and whose another part covers the inner side of the above upper side's arc guider, a lower fixed frame whose one part is installed between the above lower part's side panel's upper end and the above lower side's arc guider and whose another side covers the above lower side's arc guider's inner side, and a middle sealing material that is installed between the above upper fixed frame and the above lower fixed frame and that seals the space between the above upper fixed frame and the above lower fixed frame.

Each of the above upper fixed frame and above lower fixed frame could include a vertical side that touches one side of the above link material when viewed while the above upper side panel and the above lower side panel are unfolded and a horizontal side that touches another side that is opposite to the above side of the above link material when viewed while the above upper side panel and the above lower side panel are in a folded state. When the above folding starts, the above lower side panel rotates with the above second side rotational axis as the reference point by own weight, and one side of the above link material could be bound by the above vertical side of the above upper fixed frame, and while the above folding continues the above link material is fastened by the above lower fixed frame's above horizontal side, and the above upper side panel could rotate with the above second side rotational axis as the reference point.

The foldable container according to the embodiment of the present invention described above could additionally include an opening prevention part that prevents the above side rotation guide from being opened when weight is applied to the above foldable container's outer direction and inner direction during the time before the above upper side panel and the above lower side panel are folded.

Effects of the Invention

As described above, the foldable container according to the embodiment of the present invention could have the following effects.

According to the embodiment of the present invention, a technical configuration wherein the left side panel and the right side panel are folded, wherein a fixing bar is installed on the rear panel's outer side, wherein on the above panel's inner side the first and second supporting members installed to be able to move back and forth are included, and wherein the front panel and the rear panel are installed to be able to rotate on the first and second supporting members, respectively, through the upper end hinge so that each outer side of the front panel and rear panel gradually moves upward is provided, so that when the foldable container under the present invention is folded the fixing bar and the upper end hinge are positioned between the rear side's panel's outer side and the upper panel's inner side, which is the same space, so that if the foldable container under the present invention is folded it is possible to substantially reduce the entire height of the folded container compared to the conventional technology, namely even if five folded containers are layered it is possible to meet the container height according to the international specifications. Eventually, it is possible to reduce the entire height of a folded container to one fifth of the container's height in the unfolded state, so it will be possible to substantially increase space and cost in the process of storing or transporting containers compared with the conventional technology.

Also, according to the embodiment of the present invention, the technical configuration wherein the front panel and the rear panel are installed to be able to rotate on the first and second supporting members, respectively, through the upper end's hinge, and the first and second supporting members are installed to be able to move back and forth on the upper panel's inner side through the back-and-forth movement guide part is provided, so the front side panel and the rear side panel are rotated with the upper end hinge as the reference point using the method whereby the center of the rope is lifted by fixing each end of each lower part of the front panel and the rear panel at the same time the first and second supporting members can move to the center of the inner side of the upper panel through the back-and-forth movement guide, so it is possible to substantially decrease additional cost incurred to fold the foldable container under the present invention compared to the conventional technology.

Also, according to the embodiment of the present invention, each of the left panel and right panel includes the upper side panel, lower side panel, and a side rotation guide, and the side rotation guide provides a technical configuration that includes the upper side arc guide with the upper side circular arc part, the lower side arc guider with the lower circular arc part that contacts and rotates with the upper side circular arc part, the first side rotational axis, the second side rotational axis, and a link material, so that the upper circular arc part and the lower circular arc part can rotate by contacting with each other, and in the event that this rotation is completed the space between the upper side panel's outer side and the lower side panel's outer side can be minimized, and eventually it is possible to further reduce the entire height of the folded container when the foldable container under the present invention is folded. Furthermore, it is possible for the upper circular arc part and the lower circular arc part to rotate while closely contacting with each other, so the problem involving the rolling of the upper panel from left to right in the lengthwise direction of the foldable container under the present invention while the left panel and the right panel are being folded could be prevented. Eventually, due to the fact that there is no rolling of the upper panel, the additional cost incurred to prevent this could be saved.

BRIEF DESCRIPTION OF THE DRAWINGS

FIG. 1 is a perspective diagram that roughly illustrates the foldable container according to an embodiment of the present invention.

FIG. 2 is a drawing that magnifies the rear panel of the foldable container of FIG. 1.

FIG. 3 is a drawing that roughly illustrates the state before the rear panel is rotated (a), the state in which the rear panel is rotating (b), and the state in which the rear panel moves to the inner side of the upper panel through the second support (c).

FIG. 4 is a drawing from the perspective of viewing the foldable container's exterior from the rear and roughly illustrates the state in which the rear panel moves along the inner side of the upper panel while the rear panel is being rotated.

FIG. 5 is a drawing from the perspective of viewing the upper side from the exterior of the foldable container with the upper panel removed, and roughly illustrates the state of FIG. 3 (c).

FIG. 6 is a drawing from the perspective of viewing the upper side and the rear side from the inside of the foldable container with the upper panel removed, and roughly illustrates the state in which the rear panel is closed by the second upper part's locking part.

FIG. 7 is a drawing from the perspective of viewing the rear side from the outside of the foldable container of FIG. 2, and roughly illustrates the process in which the rear panel is closed by the second lower locking part through (a) and (b).

FIG. 8 is a drawing that roughly illustrates the door hinge of the foldable container of FIG. 2.

FIG. 9 is a drawing that roughly illustrates the weight dispersion part by removing part of the door panel of FIG. 8.

FIG. 10 is a drawing from the perspective of viewing the exterior of the foldable container, and is a perspective diagram that illustrates the main component of the right panel.

FIG. 11 is a perspective diagram that roughly illustrates the state in which the upper side panel and the lower side panel are being rotated by the side rotation guide part.

FIG. 12 is a perspective diagram that roughly illustrates the state in which the lower side panel of FIG. 10 is being rotated by the lower end hinge.

FIG. 13 is a drawing that sequentially illustrates the states of the side rotation guide part with (a), (b), (c), (d), and € while the upper side panel and the lower side panel are being folded.

FIG. 14 is a drawing that roughly illustrates with (a), (b), and (c) the process in which the upper side panel and the lower side panel are being folded by the side rotation guide part.

FIG. 15 is a drawing from the perspective of viewing from the rear the state in which the foldable container of FIG. 1 is in the folded state.

FIG. 16 is a drawing that sequentially illustrates the process in which the foldable container of FIG. 1 is being folded.

FIG. 17 is a drawing that roughly illustrates the state in which five of the foldable containers of FIG. 15 have been layered.

BEST FORM TO EMBODY THE PRESENT INVENTION

Below, the present invention will be described in detail in order for any person with ordinary level of knowledge in the technological field in which the present invention belongs will be able to embody the embodiment of the present invention by referring to the attached drawings. However, the present invention can be embodied in various different forms, and is not limited to the embodiment described here.

On the other hand, the term "inner side" used below refers to the side that is located inside the foldable container under the present invention, and the term "outer side" refers to the side that is located at the exterior of the foldable container under the present invention.

FIG. 1 is a perspective diagram that roughly illustrates the foldable container according to an embodiment of the present invention, FIG. 2 is a drawing that magnifies the rear panel of the foldable container of FIG. 1, and FIG. 3 is a drawing that roughly illustrates the state prior to the rear panel's rotation (a), the state in which the rear panel has been rotated (b), and the state in which the rear panel is being moved to the inside of the upper panel through the second support. FIG. 4 is a drawing from the perspective of viewing the rear from the foldable container's exterior, and is a drawing that roughly illustrates the state in which the rear panel moves along the inner side of the upper panel while being rotated, and FIG. 5 is a drawing from the perspective of viewing the upper side from the exterior of the foldable container after removing the upper panel.

FIG. 6 is a drawing from the perspective of viewing the upper side and the rear side from the foldable container's inside after removing the upper panel, and is a drawing that roughly illustrates the state in which the rear panel is closed by the second upper locking part, and FIG. 7 is a drawing from the perspective of viewing from the exterior of the foldable container of FIG. 2 and is a drawing that roughly illustrates through (a) and (b) the process in which the rear panel is being closed by the second lower locking part.

FIG. 8 is a drawing that roughly illustrates the door hinge of the foldable container of FIG. 2, and FIG. 9 is a drawing that roughly illustrates the weight dispersing part after removing part of the door panel of FIG. 8.

FIG. 10 is a drawing from the perspective of viewing the foldable container from the outside, and is a perspective diagram that roughly illustrates the important part of the right panel, FIG. 11 is a perspective diagram that roughly illustrates the state in which the upper side panel and the lower side panel of FIG. 10 are being rotted by the side rotation guide part, FIG. 12 is a perspective diagram that roughly illustrates the state in which the lower side pane of FIG. 10 is being rotated by the lower hinge, and FIG. 13 is a drawing that sequentially illustrates with (a), (b), (c), (d), and (e) the state of the side rotation guide while the upper side panel and the lower side panel are being folded.

FIG. 14 is a drawing that roughly illustrates with (a), (b), and (c) the process in which the upper side panel and the lower side panel are being folded by the side rotation guide part, FIG. 15 is a drawing from the perspective of viewing from the rear the state in which the foldable container of FIG. 1 has been folded, FIG. 16 is a drawing that sequentially illustrates the process in which the foldable container of FIG. 1 is being folded, and FIG. 17 is a drawing that roughly illustrates the state in which five of the foldable containers of FIG. 15 have been layered (FC1-FC5).

As illustrated in FIG. 1 to FIG. 17, the foldable container (FC) according to an embodiment of the present invention includes an upper panel (110), a lower panel (120), a side panel (130), a right panel (140), a front panel (150), a rear panel (160), the first support (not illustrated), and the second panel (210). Below, each of the components will be described in detail by continuing to refer to FIG. 1 through FIG. 17.

When we refer to FIG. 1, we can see that the upper panel (110) is the component that comprises the upper side of the foldable container (FC) under the present invention, and the lower panel (120) is the component that comprises the lower side of the foldable container (FC) under the present invention. Each of these upper panel (110) and lower pane (120) could usually be composed of a frame that comprises the outer frame, a panel that is fixed inside this frame, and so on.

When we refer to FIG. 1 and FIG. 3, we can see that the left panel (130) is the component that comprises the left side of the foldable container (FC) under the present invention, and the right panel (140) is the component that comprises the right side of the foldable container (FC) under the present invention. Each of these upper panel (110) and lower panel (120) panel could usually be comprised of a frame that comprises the outer frame, a panel fixed inside the frame, and so on, and could be in the form a structure that is folded through a side rotational guide part (600) to be described later. Furthermore, the left panel (130) and the right panel (140) could be positioned symmetrically on the left and right sides.

When we refer to FIG. 1 through FIG. 3, we can see that the front panel (150) is the component that comprises the front side of the foldable container (FC) under the present invention, and the rear panel (160) is the component that comprises the rear side of the foldable container (FC) under the present invention. Here, the front panel (150) could usually be composed of a frame that comprises the outer frame, a panel fixed to the inside of this frame, and so on. On the other hand, the rear frame (160) plays the role of the door of the foldable container (FC) under the present invention, and as illustrated in FIG. 8, could include a door frame (161) in the shape of a rectangular frame equipped with a vertical bar (161*a*) and a horizontal bar (161*b*) and a door panel (162) equipped to be able to rotate left and right on the door frame (161).

Furthermore, as illustrated in FIG. 1 and FIG. 8, a fixing bar (170) could be installed on the outer side of the rear panel (160) to prevent the door panel (162) from being opened during transportation.

As illustrated in FIG. 4 and FIG. 5, the second support (21) is installed to be able to move back and forth inside of the upper panel (110), and could be positioned lengthwise in the direction of the width of the upper panel (110). In this case, as illustrated in FIG. 4, the rear panel (160) could be installed to be able to rotate on the second support (210) through the upper end hinge (220). Furthermore, although not illustrated, the above first support has the same structure as the second support except for the location, and in this case the front panel could be installed to be able to rotate on the first support through another upper end hinge in order for its outer side to gradually move upward.

Therefore, when the foldable container (FC) under the present invention is folded as illustrated in FIG. 14 through FIG. 16, as illustrated in FIG. 15 the fixing bar (170) and the hinge (220) are positioned between the outer side of the rear panel (160) and the inner side of the upper panel (110), which is the same space, so that when the foldable container (FC) under the present invention is folded the entire height of the folded container can be substantially reduced compared to the conventional technology. Namely, as illustrated in FIG. 17, even if five folded containers (FC) are layered, the height can meet the container height according to the international specifications. Eventually, it is possible to reduce the entire height of the folded container (FC) to one fifth of the entire height of the container before being folded, so that it is possible to reduce space and cost substantially compared to the conventional technology in the process of storing or transporting empty containers.

Also, by fixing both ends of each lower end of the front panel (150) and he rear panel (160) using a rope (not illustrated) to lift the center part, the front panel (150) and the rear panel (160) are rotated with each upper end hinge (220) as the reference point at the same time being moved to the inner side of the upper panel (110) by the first part (not illustrated) and the second part (210), so that it is possible to substantially reduce the additional cost to reduce the foldable container (FC) under the present invention compared to the conventional technology.

As illustrated in FIG. 4 and FIG. 5, the second support (210) can be installed to be able to move back and forth inside the upper panel (110) by the back-and-forth movement guide part (230). Of course, although not illustrated, the first support could be installed to move back and forth inside the above panel by the above back-and-forth movement guide part.

For example, the above back-and-forth movement guide (230) could include, as illustrated in FIG. 4 and FIG. 5, a guiding rail (231), the first roller part (not illustrated), and the second roller part (232).

The guiding rail (231) could be installed lengthwise on each of the left end and right end of the inside of the upper panel (110), and the second roller part (232) is installed to be able to rotate on each of both ends of the second support (210), and one or more rollers could be installed to be able to slide on each of the guiding rails (231). Furthermore, although not illustrated, the first support and the first roller have the same configuration as the second support and the second roller except for the location, so detailed description regarding these will be skipped.

Along with this, the foldable container (FC) according to an embodiment of the present invention could additionally include a locking part (300) that intercepts the rotation of the rear panel (160) and the back-and-forth movement of the second support (210), as illustrated in FIG. 5 to FIG. 7.

For example, the locking part (500) could the upper locking part (310) that fastens the upper end of the rear panel (160) and the rear end of the upper panel (110), as illustrated in FIG. 5 and FIG. 6, and the lower locking part (320) that fastens the lower end of the rear panel (160) and the rear end of the lower panel (120), as illustrated in FIG. 7.

As illustrated in FIG. 5 and FIG. 6, the above locking part (310) could include an upper fastening bolt (311), an upper latching groove (312), an upper fastening nut (313), and a washer (314). The upper fastening bolt (311) could protrude to the rear end of the upper panel (110), and could have a screw thread on the outer circumference surface, and the upper latching groove (312) has an upper latching groove so that the upper fastening bolt (311) can latch, and could be installed on the rear panel (160)'s upper end, and the upper fastening nut (313) could be screwed to the upper fastening bolt (311) while the upper fastening bolt (311) is latched to the upper latching groove. A washer (314) could be installed between the upper latching groove (312) and the upper fastening nut (313) in order to ensure that the upper fastening nut (313) does not fall through the upper latching groove.

Also, as illustrated in FIG. 7, the lower locking part (320) could include a lower fastening pin (321), the first lower latching groove (322), second lower latching groove (323), and the lower door latching groove (324). The first lower latching groove (322) could be formed on the first vertical rib (L1) installed on the rear end of the lower panel (120) to protrude upward, and the second lower latching groove (323) could be formed on the second vertical rib (L2) installed to protrude upward on the rear end of the lower panel (120) with space in the back-and-forth direction with the first vertical rib (L1). Also, the lower door latching groove (324) could be formed on the door panel (160)'s lower end in order to correspond with the first and second lower latching grooves (322) (323). Therefore, the lower end of the rear panel (160) and the rear end of the lower panel (120) could be fixed in the form in which the lower fastening pin (321) is sequentially inserted to the first lower latching groove (322), to the lower door's latching groove (324), and to the second lower latching groove (323).

Furthermore, although not illustrated, such a locking part (300) has the same configuration except for the location, and could be installed in order to intercept the rotation of the front panel and the back-and-forth movement of the first support.

Along with the above, as illustrated in FIG. 8 and FIG. 9, the foldable container (FC) according to an embodiment of the present invention could additionally include a weight disperser (400) that disperses to the vertical bar (161*b*) of the door frame (161) through the door panel (162) the compressed weight in the left and right direction that is applied on the door frame (161)'s vertical bar (161*a*) while being unfolded.

For example, as illustrated in FIG. 8 and FIG. 9, the weight disperser (400) could include the first and second latching parts (410) (420), the third latching part (430), and an elastic material (440). The first and second latching parts (410) (420) could be installed in a vertical direction on the outer side of the door panel (162), and the third latching part (430) could be installed on each of the upper and lower horizontal bars (161*b*) of the door frame (161) in order to correspond to the first and second latching parts (410) (420). The elastic material (440) could have a long shape with a single bar inserted between two cylinders and fastened with screw threads in different directions, and could have the configuration in which the screw threads loosen when the lever (450) installed on the bar is pulled in order for the bar to extend lengthwise. Therefore, the elastic material (440) latches on the first and second latching parts (410) (420) and becomes extended during the state in which the foldable container (FC) under the present invention is not folded to latch to the third latching part (430) and contracts during the state in which the foldable container (FC) under the present invention is folded to derail from the third latching part (430), and could have a long shape.

On the other hand, as illustrated in FIG. 6 and FIG. 8, the rear panel (160) described above could additionally include a door hinge (500) that prevents the door panel (162) from being latched to the right panel (140) while being opened by rotating left and right to rotate the door panel (162) 270 degrees in the right direction relative to the door frame (161). Of course, as illustrated in FIG. 1, if the door panel (162) is divided in two from left to right such a door hinge (500) could be installed on both sides.

For example, the door hinge (500) could include the first hinge (510) and the second hinge (520), as illustrated in FIG. 6 and FIG. 8. The first hinge (510) could be installed so that one end can be rotated on the door panel (162) by the first hinge axis (H1), the second hinge (520) could be installed so that one end can be rotated on another end of the first hinge (510) by the second hinge axis (H2), and that another end could be rotated on the door frame (161) by the third hinge axis (H3). Therefore, while the door panel (162) is prevented from being latched to the right panel (140) while being opened by rotating left and right through such a three-level hinge structure in order to rotate the door panel (162) 270 degrees in the right direction relative to the door frame (161).

On the other hand, although no illustrated, in the areas of the upper panel, lower panel, left panel, right panel, front panel, and rear panel that intersect, peripheral sealing materials could be installed. Therefore, as illustrated in FIG. 1, when the foldable container (FC) under the present invention is unfolded, the components could be sealed by the peripheral sealing material. For reference, the symbol "DS" in FIG. 8 represents the sealing material to seal the space between the rear panel (160) and the right panel (140), the symbol "SS1" in FIG. 10 represents the sealing material to seal the space between the upper side panel (P1) and the corresponding area, and the symbol "SS2" in FIG. 10 is the sealing material that seals the space between the lower side panel (P2) and the corresponding part.

On the other hand, each of the left panel (130) and the right panel (140) described above could include an upper side panel (P1), a lower side panel (P2), and a side rotation guide (600) as the folding configuration, as illustrated in FIG. 10 and FIG. 14.

The upper side panel (P1) is the upper part in the middle based on the vertical direction and its upper end could be installed to be able to rotate on the upper panel (110), and the lower side panel (P2) is the lower part in the middle in the vertical direction, the lower end could be installed to be able to rotate on the lower panel (120), and the side rotation guide (600) connects the upper side panel (p1)'s lower end and the lower side panel (P2)'s upper end so that they can rotate with each other, and rotation could be guided so that the upper side panel (P1) and the lower side panel (P2) can slope toward inside of the foldable container (FC) under the present invention.

For example, as illustrated in FIG. 10 and FIG. 11, the side rotation guide (600) could include one or more upper arc guiders (610), one or more lower arc guiders (620), the first side rotation axis (S1), the second side rotation axis (S2), and one or more link materials (630).

One or more upper arc guiders (610) are installed at the lower end of the upper side panel (P1), and could have an upper circular arc part in the shape of a circular arc, one or more lower arc guiders (620) are installed at the upper end of the lower side panel (P2), and can have a lower circular arc part in the shape of a circular arc that rotates by coming into contact with the upper circular arc part, the first side rotation axis (S1) could be installed at the center of the upper circular arc part of each upper arc guider (610) to be able to rotate, the rotation axis (S2) on the second side could be installed at the center of the lower circular arc part of each lower arc guider (620) to be able to rotate, and one or more link materials (630) could connect the first side rotation axis (S1) and the second side rotation axis (S2).

Therefore, since the upper circular arc part of the upper arc guider (610) and the lower circular arc part of the lower arc guider (620) can rotate by coming into contact with each other, so when this rotation is completed, as illustrated in FIG. 15 it is possible to minimize the space between the upper side panel (P1)'s outer side and the lower side panel (P2)'s outer side, and eventually the entire height of the folded container can be further reduced when the foldable container (FC) under the present invention is folded. Also, since it is possible for the upper arc guider (610) and the lower arc guider (620) to rotate by closely contacting with each other, the problem involving the rolling of the upper panel (110) left and right with the lengthwise direction of the foldable container under the present invention while the left panel (130) and the right panel (140) are being folded could be prevented. Eventually, due to the fact that there is no rolling of the upper panel (110), additional cost to prevent this occurrence can be saved.

Furthermore, as illustrated in FIG. 10, one or more side arc guiders (610) could include the first and second side arc guiders (611) (612), and one or more lower arc guiders (620) could include the first and second lower arc guiders (621) (622). The side rotation guide (600) could have an upper arc spacer (640) that covers the space between the first and second upper arc guiders (611) (612) and that is equipped with a circular arc type cover in the shape of a circular arc, and a lower arc spacer (650) that covers the space between the first and second lower arc guiders and that is equipped with a lower circular arc type cover that rotates by contacting with the upper circular arc type cover.

Also, although not illustrated, if one or more upper arc guiders (610) comprise of multiple upper arc guiders (610), they can be positioned relatively densely in the area near the rear panel (160) of the upper side panel (P1)'s lower end, and they could be positioned relatively less densely at the center of the upper side panel (P1) (refer to FIG. 2). Therefore, relatively more numerous upper arc guiders (610) and lower arc guiders (620) are installed on the rear panel (160) where weight is concentrated, so it is possible to support weight efficiently. For the same reason, although not illustrated, multiple upper arc guiders could be positioned relatively densely in the area that borders the front panel in the lower end of the upper side panel.

Along with this, the side rotation guide (600) described above, could additionally include a middling sealing part (MS) between the upper arc guider (610) and the lower arc guider (620) in order to seal parts while the foldable container (FC) under the present invention is in the unfolded sated, as illustrated in FIG. 11.

For example, as illustrated in FIG. 11, the middle sealing part (MS) could further include the upper fixed frame (660), the lower fixed frame (670), and the middle sealing material (680).

Part of the upper fixed frame (660) is installed between the lower end of the upper side panel (P1) and the upper arc guider (610), and another part can cover the inner side of the upper arc guider (610), and part of the lower fixed frame (670) is installed between the lower side panel (P2)'s upper end and the lower arc guider (620), and the other part can cover the inner side of the lower arc guider (620), and the middle sealing material (680) is installed on the lower fixed frame (670) and is exposed in the upper direction to come into contact closely with the upper fixed frame (660).

On the other hand, as illustrated in FIG. 13(*a*) and €, each of the upper fixed frame (660) and lower fixed frame (670) could include vertical sides (660*a*) (670*a*) that come into contact with a side of the link material (630) when viewed while the upper side panel (P1) and the lower side panel (P2) are in the unfolded state and the horizontal sides (660*b*) (670*b*) that come into contact with the other side that is opposite to the above side in the link material (630) when viewed while the upper side panel (P1) and the lower side panel (P2) are in the unfolded state.

Therefore, as illustrated in FIGS. 13(*a*) and (*b*), when initial folding starts the force that pulls in the direction of the arrow (1) is applied on the lower side panel (P2) due to own weight, and at this time the lower side panel (P2) rotates with the second side rotational axis (S2) as the reference point, and the link material (630) is fastened at the upper fixed frame (660)'s vertical side (660*a*) and cannot rotate as a result. Afterwards, as illustrated in FIG. 13(*c*), while continuing to be folded downward, the link material (630) does not rotate any more after being fastened to the horizontal side (670*b*) of the lower fixed frame (670). In this state, the upper side panel (P1) rapidly rotates in the direction of the arrow (2) with the second side's rotational axis (S1) as the reference point, as illustrated in FIGS. 13 (c), (*d*), and (*e*). Eventually, due to the vertical side (660*a*) and horizontal side (670*b*) of each of the upper fixed frame (660) and lower fixed frame (670) and due to the link material (630)'s sides, the lower side panel (P2) and the upper side panel (P1) are controlled precisely to 90 degrees and folded with the second side rotational axis (S2) and the first side rotational axis (S1) as the reference points, respectively, and as a result of being controlled precisely as described above, it is possible to prevent damages to the middle sealing material (680) located between the lower fixed frame (670) and the upper fixed frame (660).

Along with the above, as illustrated in FIG. 1 and FIG. 2, the foldable container (FC) according to an embodiment of the present invention could additionally include an opening prevention material (700) that prevents the side rotation guide (600) from opening when weight is applied to the outer direction and inner direction of the foldable container (FC) under the present invention while the upper side panel (P1) and the lower side panel (P2) are in the unfolded state. Furthermore, as illustrated in FIG. 15, this opening prevention material (700) is fastened to the first lower latching groove (322) using separate bolts in order for the foldable container (FC) under the present invention to remain folded after being folded to connect the upper panel (110) and the lower panel (120).

Although an advisable embodiment of the present invention was described in detail above, the scope of rights of the present invention is not limited to this, but various modifications and improvements by those in the industry using the basic concepts of the present invention defined in the following scope of claims section are within the scope of the rights of the present invention.

POSSIBILITY OF INDUSTRIAL USE

Since the present invention is about containers, the present invention can be applied to freight transportation, so there is a possibility of industrial use.

The invention claimed is:

1. A foldable container comprising an upper panel and a lower panel respectively forming the upper surface and lower surface thereof; a left panel and a right panel respectively forming the left surface and right surface thereof, and respectively folded; a front panel and a rear panel respectively forming the front surface and rear surface thereof; and a fixing bar provided at the outer surface of the rear panel, and further includes first and second supporting members provided at the inner surface of the upper panel so as to be movable forwards and backwards, wherein the front panel and the rear panel are respectively and pivotally provided at the first and second supporting members by means of upper hinge parts such that the respective outer surfaces thereof gradually face upwards.

2. The foldable container of claim 1, wherein each of the supporting members is installed inside the upper panel to be able to move back and forth by a back-and-forth guide part.

3. The foldable container of claim 2, wherein the back-and-forth guide part includes guide rails that are installed lengthwise on the inner side's left and right end of the upper panel, respectively, a first roller part equipped with one or more rollers that are installed on both ends of the first supporting member to be able to rotate and to be able to slide on each guide rail, and a second roller part equipped with one or more rollers installed to be able to rotate on both ends of the second supporting member and to slide on each of the guide rails.

4. The foldable container of claim 1, wherein the foldable container additionally includes a locking part that intercepts the rotation of the rear panel and the back-and-forth movement of the second supporting member.

5. The foldable container of claim 4, wherein the locking part includes an upper locking part that fastens the rear panel's upper end and the upper panel's rear end and a lower locking part that fastens the rear panel's lower end and the lower panel's rear end.

6. The foldable container of claim 1, wherein the rear panel includes a door frame in the shape of a rectangular frame equipped with a vertical bar and a horizontal bar and a door panel installed to be able to rotate left and right on the door frame and wherein the foldable container further includes a weight dispersing part that disperses weight in the left and right direction applied to the vertical bar of the door frame in the unfolded state to the horizontal bar of the door frame through the door panel.

7. The foldable container of claim 6, wherein the weight dispersing part includes first and second latching parts that are installed in a vertical direction inside the door panel, a third latching part is installed on each of upper horizontal bar and lower horizontal bar of the door frame to correspond to the first and second latching parts, and a long elastic part that latches to the first and second latching parts and that is extended when the foldable container is in the unfolded state to latch to the third latching part together and contracts when the foldable container is in the folded state to be removed from the third latching part.

8. The foldable container of claim 1, wherein the rear panel includes a door frame in the shape of a rectangular frame, a door panel that is installed in such a way as to be able to rotate left and right on the door frame, and a door hinge that rotates the door panel 270 degrees to the left direction or right direction relative to the door frame by preventing the left panel or right panel from being latched while the door panel is being opened by rotating left and right.

9. The foldable container of claim 8, wherein the door hinge includes a first hinge part whose one part is installed on the door panel to be able to be rotated by the first hinge axis and a second hinge part whose one part is installed on the first hinge part to be able to be rotted by the second hinge axis and whose another part is installed on the door frame to be able to be rotated by a third hinge axis.

10. The foldable container of claim 1, wherein the foldable container is installed with peripheral sealing materials on the areas where the upper panel, the lower panel, the left panel, the right panel, the front panel, and the rear panel adjoin each other.

11. The foldable container of claim 1, wherein each of the left panel and the right panel includes an upper side panel installed in such a way so that the upper end can rotate on the upper panel, a lower side panel installed in such a way so that the lower end can rotate on the lower panel, and a side rotation guide part that connects the lower end of the upper side panel and the upper end of the lower side panel so that they can rotate with each other and that guides rotation so that the upper side panel and the lower side panel fold by sloping to the inside of the foldable container.

12. The foldable container of claim 11, wherein the side rotation guide part includes one or more upper arc guides that are installed on the lower end of the upper side panel and that have one or more upper circular arc parts in the shape of circular arc, a lower arc guider that is installed on the upper end of the lower side panel and that has a lower circular arc part in the shape of circular arc that rotates by contacting with the upper circular arc part, a first rotational axis is installed at the center of the upper circular arc part of each of the upper arc guiders to be able to rotate, second rotational axis is installed at the center of the lower circular arc part of each of the lower arc guiders to be able to rotate, and one or more link parts that connect the first side rotational axis and the second rotational axis.

13. The foldable container of claim 12, wherein the one or more upper arc guiders includes first and second upper arc guiders and the one or more lower arc guiders include the first and second lower arc guiders and wherein the side rotation guide part further includes an upper arc spacer that covers the space between the first and second upper arc guiders and that has an upper circular arc cover in the shape of circular arc and a lower circular arc cover in the shape of circular arc that rotates by contacting with the upper circular arc cover while covering the space between the first and second lower arc guiders.

14. The foldable container of claim 12, wherein the one or more upper arc guiders include multiple upper arc guiders, wherein the multiple upper arc guiders are relatively densely positioned in the areas near the front panel and the rear panel in the lower end of the upper side panel, and are relatively less densely positioned at the center of the upper side panel.

15. The foldable container of claim 12, wherein the side rotation guide part further includes a middle sealing part between the upper arc guider and the lower arc guider.

16. The foldable container of claim 15, wherein the middle sealing part includes an upper fixed frame whose one part is installed between the upper side panel's lower end and the upper arc guider and whose another part covers the inner side of the upper arc guider, a lower fixed frame whose one end is installed between the lower side panel's upper end and the lower arc guider and whose another part covers the lower arc guider's inner side, and a middle sealing material that is installed between the upper fixed frame and the lower fixed frame to seal the space between the upper fixed frame and the lower fixed frame.

17. The foldable container of claim 16, wherein each of the upper fixed frame and the lower fixed frame includes a vertical side that contacts one side of the link material when viewed while the upper side panel and the lower side panel are in the unfolded state, and a horizontal side that contacts the other side opposite to the one side in the link material when viewed while the upper side panel and the lower side panel are in the folded state, wherein when the folding starts the lower side panel rotates with the second side rotational axis as the reference point by own weight, wherein one side of the link material is fastened at the vertical side of the upper fixed frame, wherein the link material is fastened on the horizontal side of the lower fixed frame while the folding continues, and wherein the upper side panel rotates with the second side rotational axis as the reference point.

18. The foldable container of claim 12, wherein the foldable container further includes an opening prevention material that prevents the side rotation guide part from opening when weight is applied to the outer direction and inner direction of the foldable container while the upper side panel and the lower side panel are in the unfolded state.

* * * * *